US006484648B1

(12) United States Patent
Long

(10) Patent No.: US 6,484,648 B1
(45) Date of Patent: Nov. 26, 2002

(54) ADJUSTMENT MECHANISM FOR WORKSTATION

(76) Inventor: Dennis L. Long, 2161 Thornapple River Dr., Grand Rapids, MI (US) 49546

( * ) Notice: Subject to any disclaimer, the term of this patent is extended or adjusted under 35 U.S.C. 154(b) by 15 days.

(21) Appl. No.: 09/833,356

(22) Filed: Apr. 12, 2001

(51) Int. Cl.[7] ..... A47B 9/00
(52) U.S. Cl. ..... 108/147
(58) Field of Search ..... 108/147, 144.11, 108/22, 147.19; 248/162.1, 404, 405, 406.2, 161, 188.4, 422

(56) References Cited

U.S. PATENT DOCUMENTS

| | | | | | |
|---|---|---|---|---|---|
| 1,943,280 | A | | 1/1934 | Arnold | |
| 3,880,096 | A | * | 4/1975 | Kaplan | 108/141 |
| 4,635,492 | A | | 1/1987 | Uebelhart | |
| 5,022,327 | A | | 6/1991 | Solomon | |
| 5,088,421 | A | | 2/1992 | Beckstead | |
| 5,282,593 | A | | 2/1994 | Fast | |
| 5,447,099 | A | | 9/1995 | Adams et al. | |
| 5,685,510 | A | | 11/1997 | Frankish | |
| 5,845,590 | A | | 12/1998 | Seidl | |
| 5,890,438 | A | | 4/1999 | Frankish | |
| 5,941,182 | A | | 8/1999 | Greene | |
| 6,010,046 | A | * | 1/2000 | Neeser | 108/144.11 |
| 6,026,755 | A | * | 2/2000 | Long | 108/147 |
| 6,289,825 | B1 | * | 9/2001 | Long | 108/147 |
| 6,378,446 | B1 | * | 4/2002 | Long | 108/147 |

* cited by examiner

*Primary Examiner*—Lanna Mai
*Assistant Examiner*—Gerald A. Anderson
(74) *Attorney, Agent, or Firm*—Mary M. Moyne; Ian C. McLeod

(57) ABSTRACT

The adjustment mechanism (10) includes a stationary first member (12) and a second member (20) telescopingly mounted in the first member. A threaded member (26) is rotatably connected at the first end (26A) to the upper end (20A) of the second member. The second end (26B) of the screw extends down through a top nut (38) fixably mounted on one end of a nut support (36). A spring (40) is mounted around the screw and the nut support extends between the lower end of the first member and the upper end of the second member. An operating mechanism is used to rotate the screw. The operating mechanism allows for fewer rotations of the handle (62) of the operating mechanism to move the work surface the desired amount.

31 Claims, 8 Drawing Sheets

ADJUSTMENT MECHANISM FOR WORKSTATION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to an adjustment mechanism for adjusting the height of a work surface of a workstation. In particular, the present invention relates to an adjustment mechanism which uses rotation of a threaded member to adjust the height of the work surface. The threaded member is rotated by a handle through an operating mechanism having sprockets with different diameters which allows the threaded member to rotate at a faster rate than the rate the handle is rotated. The adjustment mechanism uses a spring to compensate for the load on the adjustment mechanism and to allow the user to rotate the handle using less force.

(2) Description of the Related Art

The related art has shown various adjustable height workstations which use a rotating, threaded member and a stationary nut to adjust the height of the table or workstation. U.S. patents which are illustrative are U.S. Pat. No. 1,943,280 to Arnold; U.S. Pat. No 5,022,327 to Solomon; U.S. Pat. No. 5,447,099 to Adams et al; U.S. Pat. No. 5,685,510 to Frankish; U.S. Pat. No. 5,845,590 to Seidel; U.S. Pat. No. 5,890,438 to Frankish; and U.S. Pat. No. 5,941,182 to Greene.

Arnold describes a table having four adjustable legs. Each leg contains an adjustment mechanism which includes a screw and a stationary nut. A sprocket is mounted at the end of each screw. The sprockets of all four adjustment mechanisms are connected together by a chain. The chain passes about a drive sprocket which is mounted on a crank or handle. When the handle is rotated, the drive sprocket rotates which rotates the sprockets and screw of each adjustment mechanism.

Solomon describes an adjustable overbed table. A rotatable screw shaft is used to adjust the table. A crank handle is attached to bevel gears which rotate bevel gears on the end of the rotatable screw shaft.

Adams et al describes a height adjustment mechanism for tables. The drive means for the mechanism comprises a gear box, a jack screw and a jack nut with a crank for rotating the jack screw by means of a pair of bevel gears. One of the bevel gears is secured to the end of the jack screw.

Frankish '510 and '586 describe a height adjustment system which includes a work-top member supported by a plurality of height adjustable legs. The legs have a stationary first leg part and a movable second leg part. A rotatable shaft extends vertically within the second leg part and has an upper portion and a lower portion. The lower portion is in the form of a screw. A pair of half nuts are positioned within the second leg part and act to position the screw within the second leg part. Vertical movement of the second leg part is also guided by at least one (1) linear bearing spaced between the first and second leg parts. The upper portion of the rotatable shaft is housed within a tubular member. A compression spring may be provided around the tubular member within the second leg part. The compression spring is retained between the lower part of the gear box housing and the base plate at the lower end of the first leg part. The compression spring is not rotatable and is fully supported within the second leg part to prevent buckling of the first leg part. The compression spring can compensate for external loads in the leg. The second leg part is secured at the upper end to the right angle gear box. The gear box includes a crown gear mounted on the upper end of the vertical shaft and a pinion gear engageable with the crown gear. The pinion gear is mounted on the end of a rotatable horizontal shaft which extends in a horizontal direction out of the gear box. The horizontal shaft is rotated by a drive mechanism comprising a winding mechanism including a rotatable drive shaft linked by universal joints and a first rotatable transmission member to a drive shaft. The drive shaft is connected to a rotatable drive transmission member which is connected to the horizontal shaft. A retractable handle is connected to the drive shaft for operating the winding mechanism. When the screw is rotated, the second leg part, gear box and work-top member move vertically relative to the first leg part.

Seidel describes an adjustable height table assembly. The base assembly includes a housing with a vertical leg extending upward and attached to the table top and movable within the housing. The housing also includes a pair of vertical guide members spaced from each other with a slide assembly slidably mounted to the guide members. The vertical leg is fixably mounted to the slide assembly. The vertical adjustment mechanism for the assembly includes a rotatable screw extending through a passage defined by the vertical leg. A tubular member is mounted within the housing between the vertical guide members, and receives the lower portion of the threaded member. A fixed nut is mounted toward the upper end of the tubular member and is threadably engaged with the threads of the screw. The table top support further includes an arm to which the table top is secured. The arm defines an axial passage, which is in communication with the passage formed in the vertical leg through which the screw extends. A driven sprocket is mounted to the screw toward its upper end, and a drive sprocket is rotatably mounted to the arm below the table top. A chain is engaged with the drive sprocket and with the driven sprocket, and a manually operable crank provides rotation of the drive sprocket, which is transferred through the chain and the driven sprocket to impart rotation to the screw and to thereby adjust the height of the table top.

Greene describes a vertically adjustable table which is adjustable using a crank handle. The leg assemblies include a stationary part and a movable part. The lifting mechanism comprises a ball screw and a ball nut. The ball nut is rigidly affixed to the stationary part of the leg assembly and the ball screw rotates in the ball nut. The table top is raised or lowered depending on the direction of rotation of the screw. The table uses a pulley and cable arrangement to ensure that the table raises and lowers in a level manner which obviating the need for a chain and sprocket. A miter gear set is used to convert horizontal torque applied by the user on the handle to the vertical torque needed to rotate the ball screw. The gear box mechanism is securely attached to a bracket which is secured to the movable portion of the leg assembly and to the underside of the table. The gear box mechanism is also securely attached to the ball screw.

Also of interest are U.S. Pat. No. 4,635,492 to Uebelhart; U.S. Pat. No. 5,088,421 to Beckstead and U.S. Pat. No. 5,282,593 to Fast which show the use of a motor to rotate the threaded member to adjust the height of a table or workstation.

There remains the need for an adjustment mechanism for use in adjusting the height of a work surface of a workstation which has a simple operating system which is manually operated by a handle which allows for fewer rotations of the handle by the user to obtain the required height adjustment and which uses a spring to compensate for a load on the work surface.

SUMMARY OF THE INVENTION

The present invention relates to an adjustment mechanism for vertically adjusting a work surface of a workstation, which comprises: a stationary first member defining a longitudinal axis of the mechanism; a movable second member connected to the work surface of the workstation and being movable relative to the stationary first member in a substantially vertical direction along the longitudinal axis of the mechanism; a support fixably mounted to the stationary first member and having a threaded opening extending substantially along the longitudinal axis of the mechanism; a threaded member rotatably connected to the movable second member and extending through the threaded opening of the support wherein threads of the threaded member engage threads of the threaded opening; a resilient means extending between the first member and the second member substantially along the longitudinal axis of the mechanism and tending to bias the members apart; one driven sprocket fixably mounted on the threaded member adjacent to the work surface; one drive sprocket directly connected to the driven sprocket and mounted on a shaft rotatably mounted on the work surface, the drive sprocket having a diameter greater than a diameter of the driven sprocket; means for directly connecting the driven sprocket and the drive sprocket; and means for rotating the shaft and the drive sprocket wherein when the drive sprocket rotates, the driven sprocket is rotated which rotates the threaded member in the threaded opening of the support such that the second member is moved relative to the first member.

Further, the present invention relates to a system for adjusting a height of a work surface of a workstation, which comprises: a primary adjustment mechanism including: a stationary first member defining a longitudinal axis of the mechanism; a movable second member connected to the work surface of the workstation and being movable relative to the stationary first member in a substantially vertical direction along the longitudinal axis of the mechanism; a support fixably mounted to the stationary first member and having a threaded opening extending substantially along the longitudinal axis of the mechanism; a threaded member rotatably connected to the movable second member and extending through the threaded opening of the support wherein threads of the threaded member engage threads of the threaded opening; a resilient means extending between the first member and the second member substantially along the longitudinal axis of the mechanism and tending to bias the members apart; one driven sprocket fixably mounted on the threaded member adjacent to the work surface; and one alignment sprocket mounted on the threaded member adjacent the work surface; at least one secondary adjustment mechanism including: a stationary first member defining a longitudinal axis of the mechanism; a movable second member connected to the work surface of the workstation and being movable relative to the stationary first member in a substantially vertical direction along the longitudinal axis of the mechanism; a support fixably mounted to the stationary first member and having a threaded opening extending substantially along the longitudinal axis of the mechanism; a threaded member rotatably connected to the movable second member and extending through the threaded opening of the support wherein threads of the threaded member engage threads of the threaded opening; a resilient means extending between the first member and the second member substantially along the longitudinal axis of the mechanism and tending to bias the members apart; and an alignment sprocket mounted on the threaded member adjacent the work surface; one drive sprocket directly connected to the one driven sprocket of the primary adjustment mechanism and mounted on a shaft rotatably mounted on the work surface, the drive sprocket having a diameter greater than a diameter of the driven sprocket of the primary adjustment mechanism; means for directly connecting the drive sprocket of the primary adjustment mechanism and the driven sprocket; and means for rotating the shaft and the drive sprocket wherein as the drive sprocket rotates, the driven sprocket is rotated which rotates the threaded shaft of the primary adjustment mechanism and the alignment sprocket of the primary adjustment mechanism; and means for connecting the alignment sprocket of the primary adjustment mechanism to the alignment sprocket of the secondary adjustment mechanism so that when the threaded shaft and the alignment sprocket of the primary adjustment mechanism rotate, the alignment sprocket and threaded member of the secondary adjustment mechanism rotate so that the primary adjustment mechanism and the secondary adjustment mechanism move at substantially the same rate.

Still further, the present invention relates to a method for adjusting a height of a work surface of a workstation which comprises the steps of: providing an adjustment mechanism for the work surface of the workstation, the adjustment mechanism including a stationary first member defining a longitudinal axis of the mechanism; a movable second member connected to the work surface of the workstation and being movable relative to the stationary first member in a substantially vertical direction along the longitudinal axis of the adjustment mechanism; a support fixably mounted to the stationary first member and having a threaded opening extending substantially along the longitudinal axis of the adjustment mechanism; a threaded member rotatably connected to the movable second member and extending through the threaded opening of the support wherein threads of the threaded member engage threads of the threaded opening; a resilient means extending between the first member and the second member substantially along the longitudinal axis of the mechanism and tending to bias the members apart; one driven sprocket fixably mounted on the threaded member adjacent to the work surface; one drive sprocket directly connected to the driven sprocket and mounted on a shaft rotatably mounted on the work surface, the drive sprocket having a diameter greater than a diameter of the driven sprocket; means for directly connecting the driven sprocket and the drive sprocket and means for rotating the shaft and the drive sprocket wherein when the drive sprocket rotates, the driven sprocket is rotated which rotates the threaded member in the threaded opening of the support such that the second member is moved relative to the first member; and activating the means for rotating the shaft and drive sprocket such that the shaft and drive sprocket rotate which rotates the threaded member which moves the second member relative to the first member which vertically adjusts the work surface.

The adjustment mechanism of the present invention allows for quick and relatively effortless adjustment of a work surface of a workstation. The adjustment mechanism includes a stationary outer member and a movable inner member telescopingly mounted in the outer member. The outer member is mounted with a lower end adjacent the ground surface. The inner member is mounted with a lower end in the upper end of the outer member and the upper end adjacent to and in contact with the underneath surface of the work surface. A screw is rotatably connected at the first end to the upper end of the inner member. The second end of the screw extends down through a nut cap fixably mounted on one end of a nut support. The other end of the nut support is mounted on the lower end of the outer member. A spring is mounted around the screw and the nut support and extends between the lower end of the outer member and the upper end of the inner member.

A driven sprocket is fixably mounted on the first end of the screw. A drive sprocket is mounted on a shaft spaced apart from the driven sprocket preferably toward the front edge of the work surface. The driven sprocket is connected by a chain to the drive sprocket. The diameter of the drive sprocket is greater than the diameter of the driven sprocket. A handle for operating the adjustment mechanism is connected to the shaft. As the handle is rotated, the driven and drive sprockets rotate which rotates the screw. Due to the larger diameter of the drive sprocket, the driven sprocket will rotate at a faster rate than the handle. As the screw rotates, it moves up and down in the top nut causing the inner member to move up and down in the outer member, thus raising or lowering the work surface. The spring extending between the lower end of the outer member and the upper end of the inner member, compensates for the load on the adjustment mechanism and allows the handle to be rotated using a reasonable force even with a load on the work surface and allows the screw to rotate at a faster rate than the handle.

An alignment sprocket is preferably fixably mounted on the upper end of the screw. The alignment sprocket is connected by a chain to the alignment sprockets of the secondary adjustment mechanisms for the workstation. The alignment sprockets ensure that all the adjustment mechanisms of a single workstation adjust the work surface at the same rate. The alignment sprocket also allows a single operating mechanism to be used to adjust multiple adjustment mechanisms of an adjustment system provided on a single workstation.

The adjustment mechanism of the present invention allows for adjusting a work surface of a workstation a greater distance in fewer rotations of the handle. The adjustment mechanism also allows for the use of a reasonable force to rotate the handle regardless of the position of the work surface. The adjustment mechanism also allows for the application of a manageable force on the handle to adjust the work surface even when a load is applied to the work surface.

The substance and advantages of the present invention will become increasingly apparent by reference to the following drawings and the description.

BRIEF DESCRIPTION OF THE DRAWING(S)

Figure 3A:
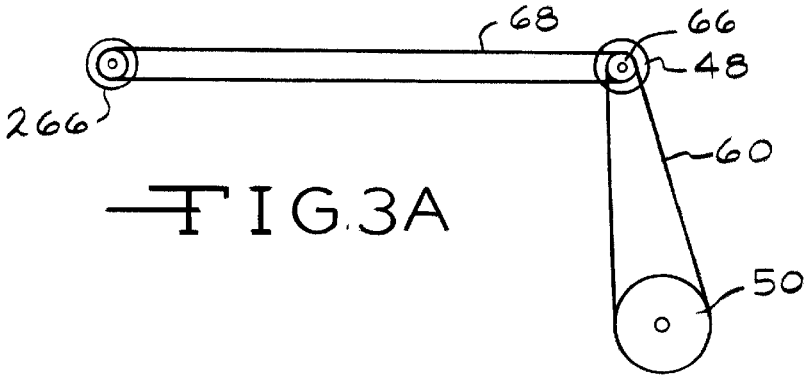
FIG. 3 is a side cross-sectional view of the workstation 100 in the lowered position with a portion of the adjustment mechanism 10 in cross-section.

FIG. 3A is a plan view of the drive sprocket 50 and the driven sprocket 48 and an alignment sprocket 266 of a secondary adjustment mechanism 200.

Figure 2:
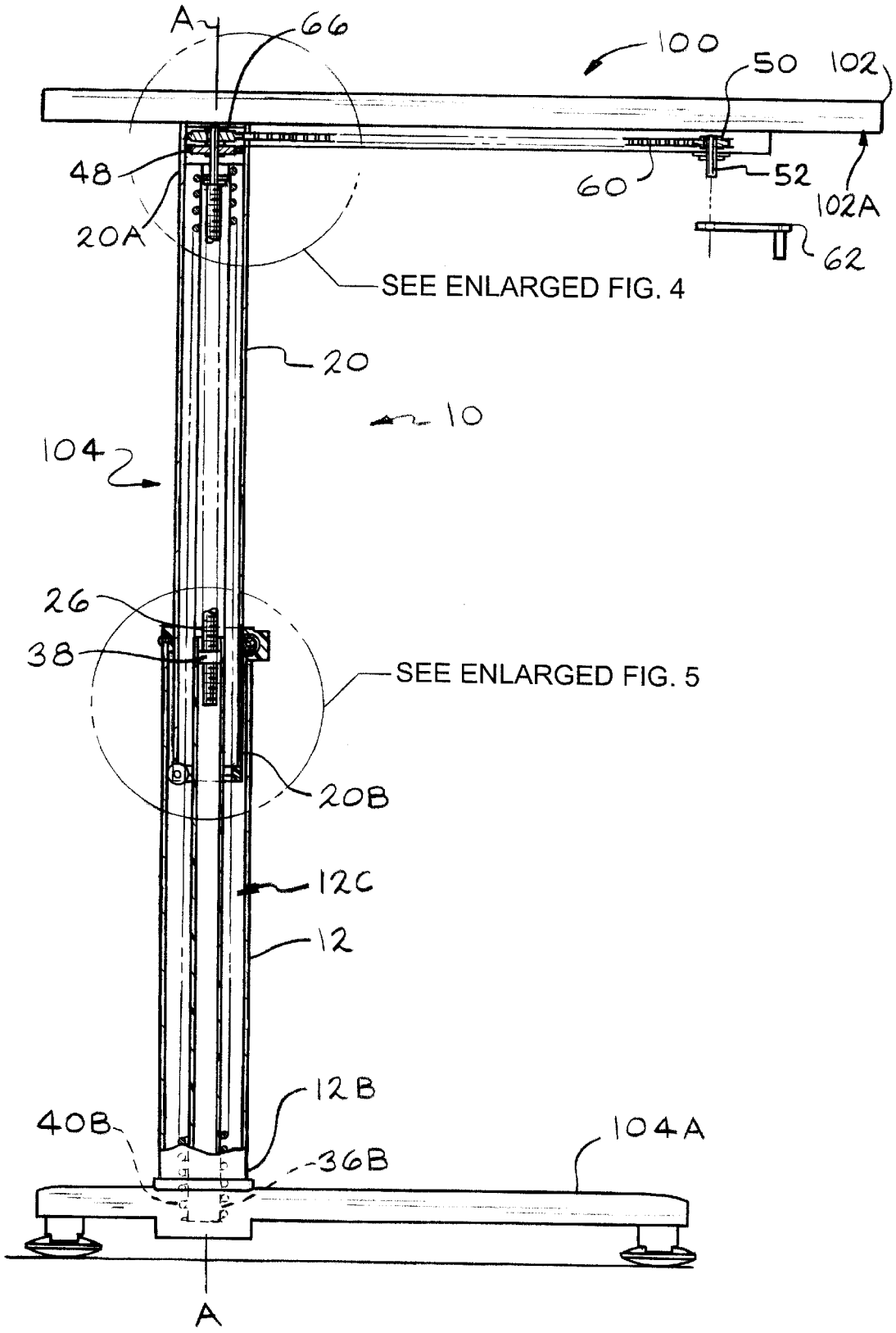
FIG. 2 is a side cross-sectional view of the workstation 100 in the raised position with a portion of the adjustment mechanism 10 in cross-section.
Figure 4:
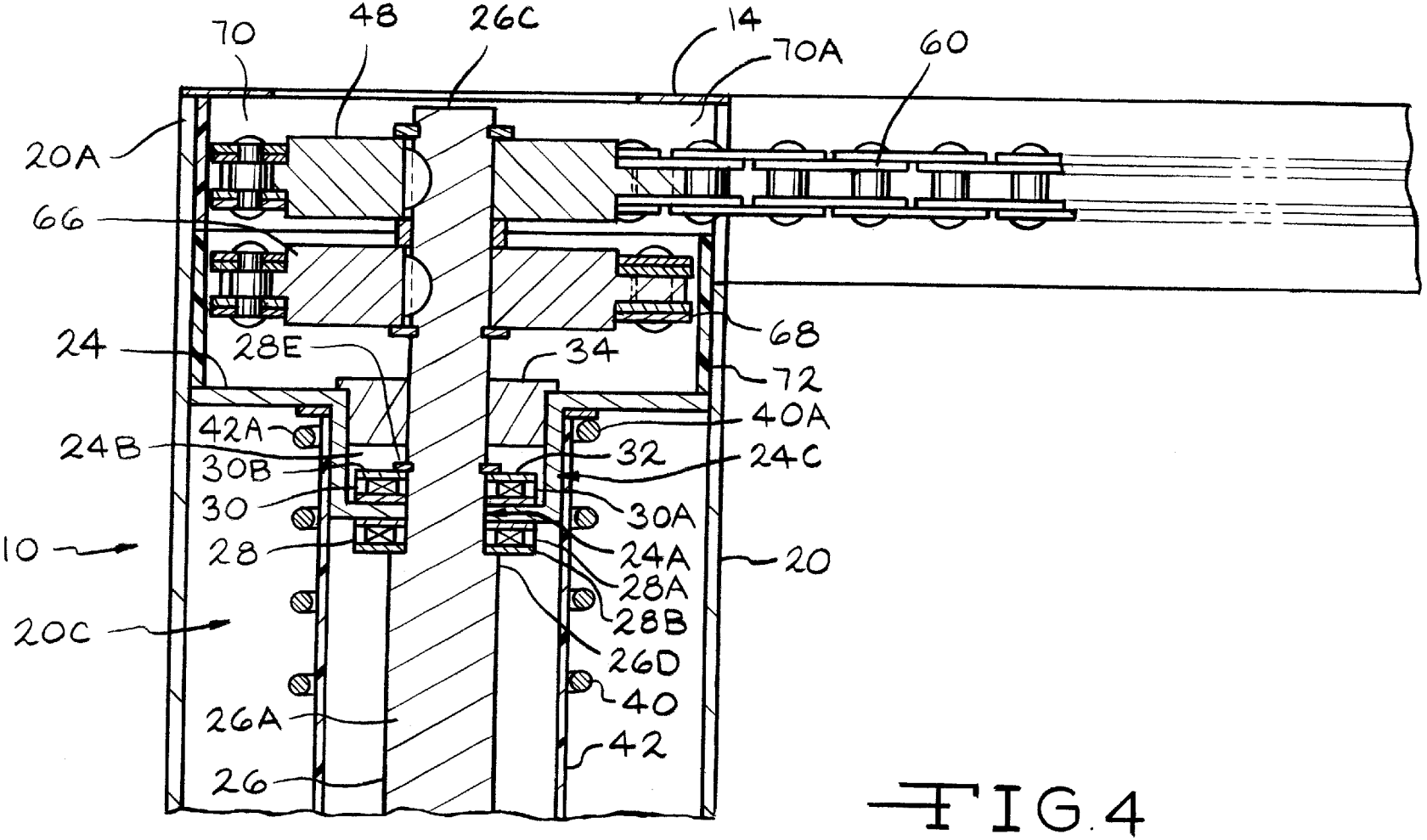

FIG. 4 is an enlarged cross-sectional view of a portion of FIG. 2 showing the driven sprocket 48 and the alignment sprocket 66 mounted on the screw 26 and showing the chains 60.

Figure 5:
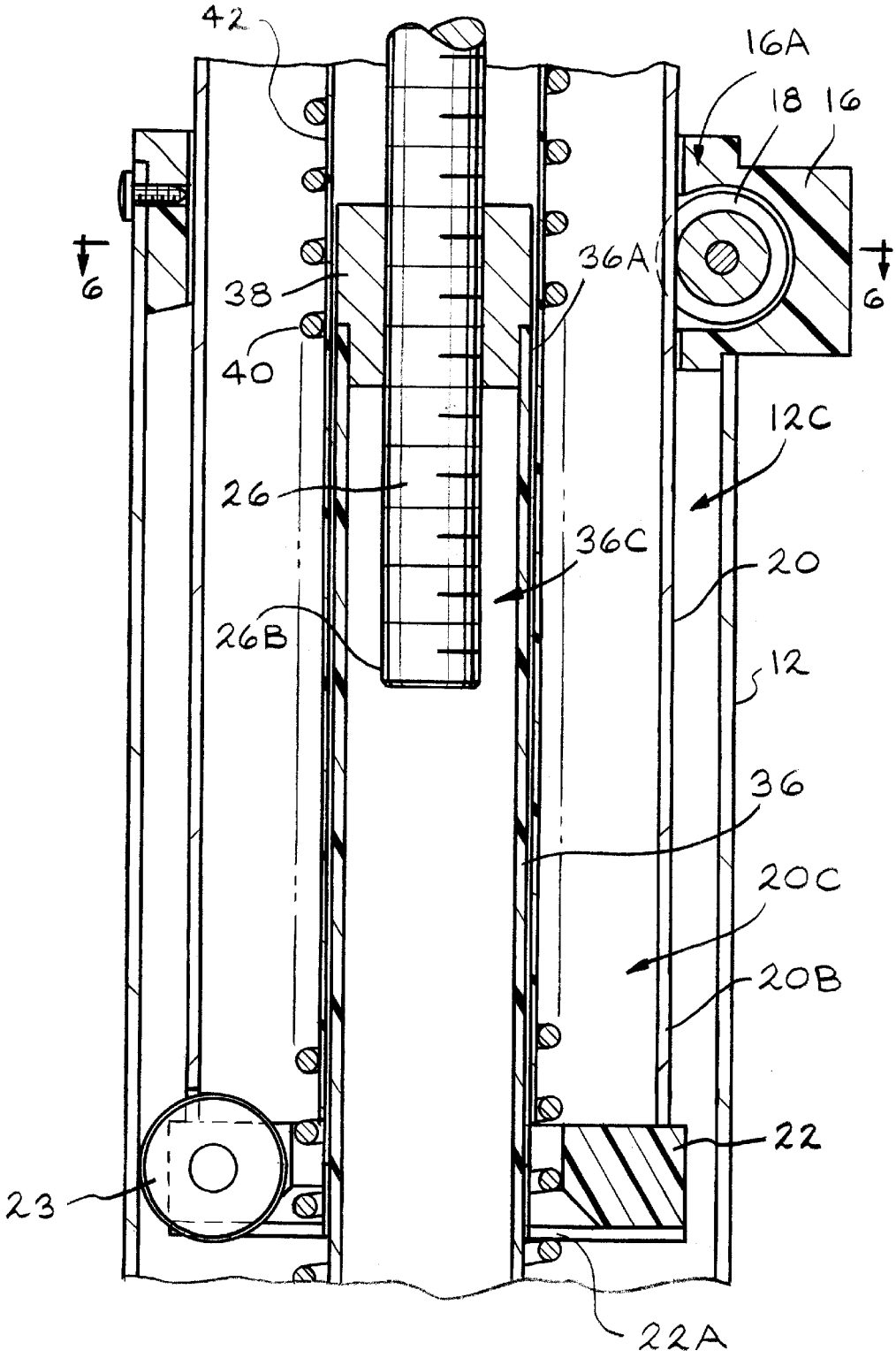

FIG. 5 is an enlarged cross-sectional view of a portion of FIG. 2 showing the second cantilever bracket 22, the screw 26 and the support 36.

Figure 6:
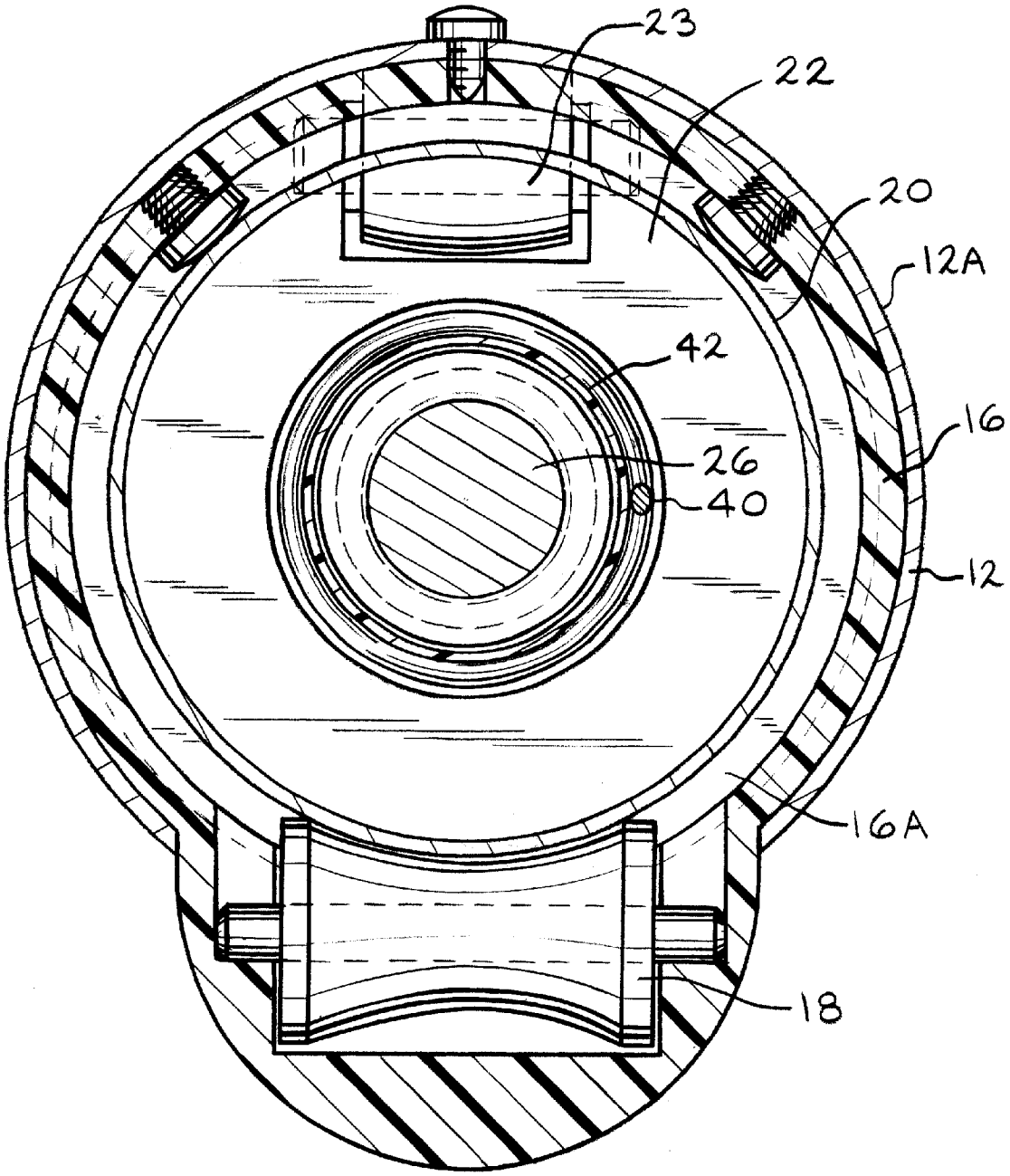

FIG. 6 is a cross-sectional view along the line 6—6 of FIG. 5 showing the first cantilever bracket 16 and first cantilever roller 18 and the second cantilever bracket 22 and second cantilever roller 23.

Figure 7:
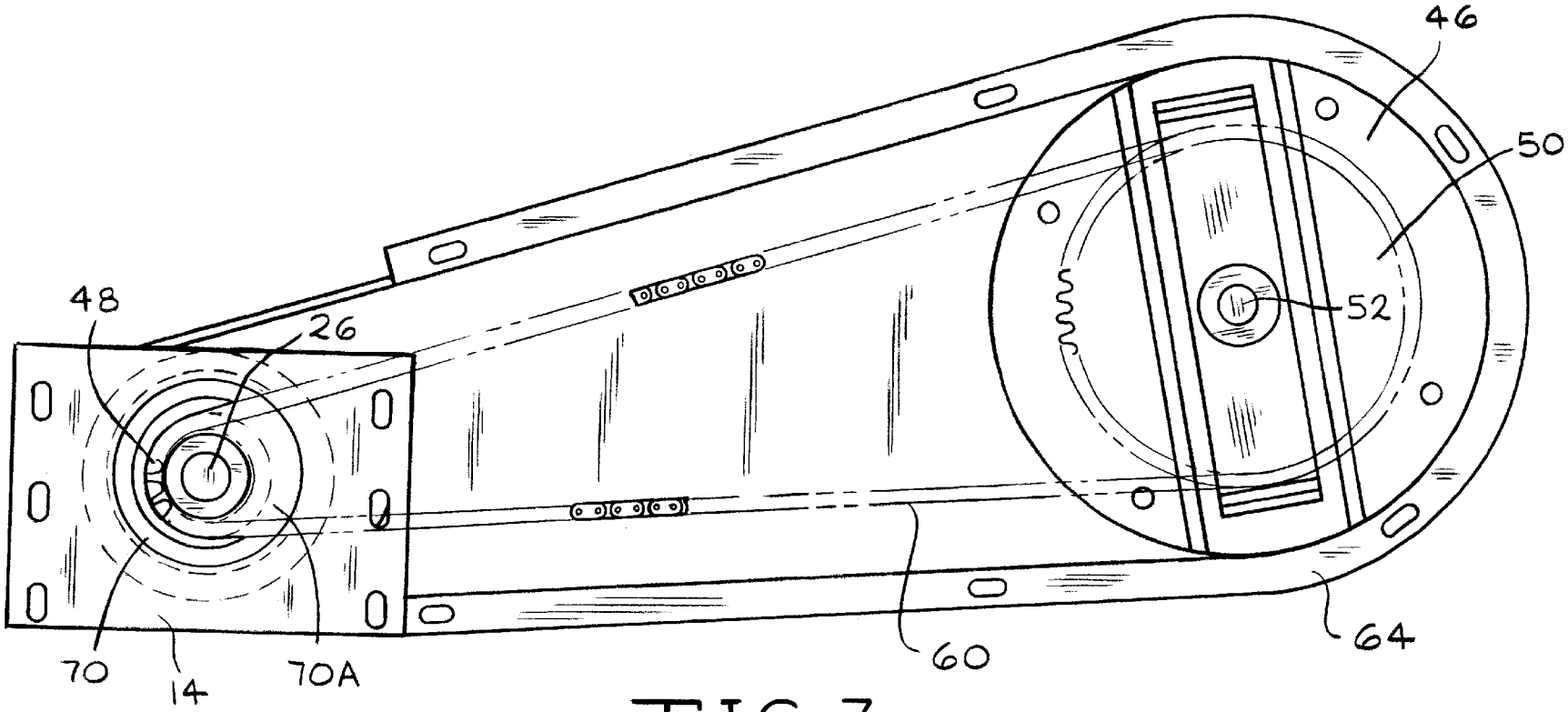

FIG. 7 is a top schematic view of the operating assembly showing the first mounting bracket 14, the driven sprocket 48, the chain 60, the drive sprocket 50, the second mounting bracket 46 and the cover 64.

Figure 8:
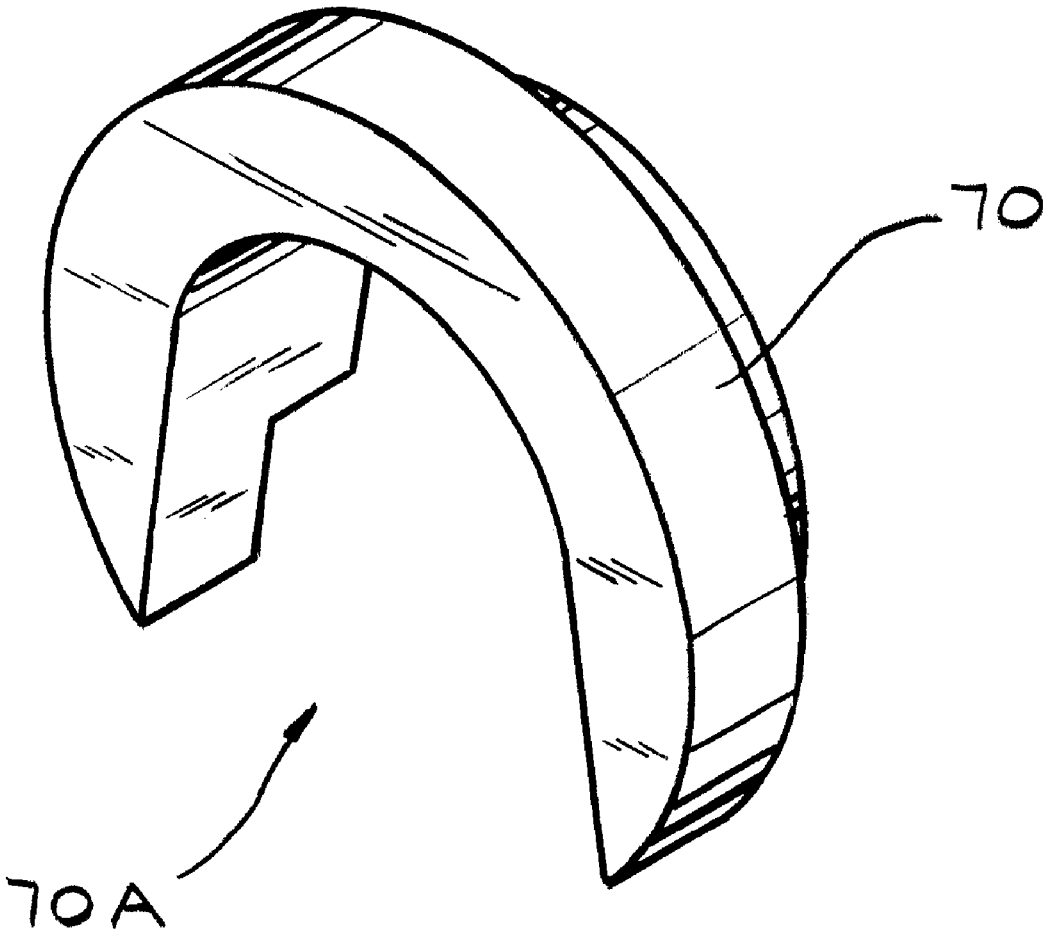

FIG. 8 is a perspective view of the chain guide 70.

DETAILED DESCRIPTION OF THE PREFERRED EMBODIMENTS

Figure 1:
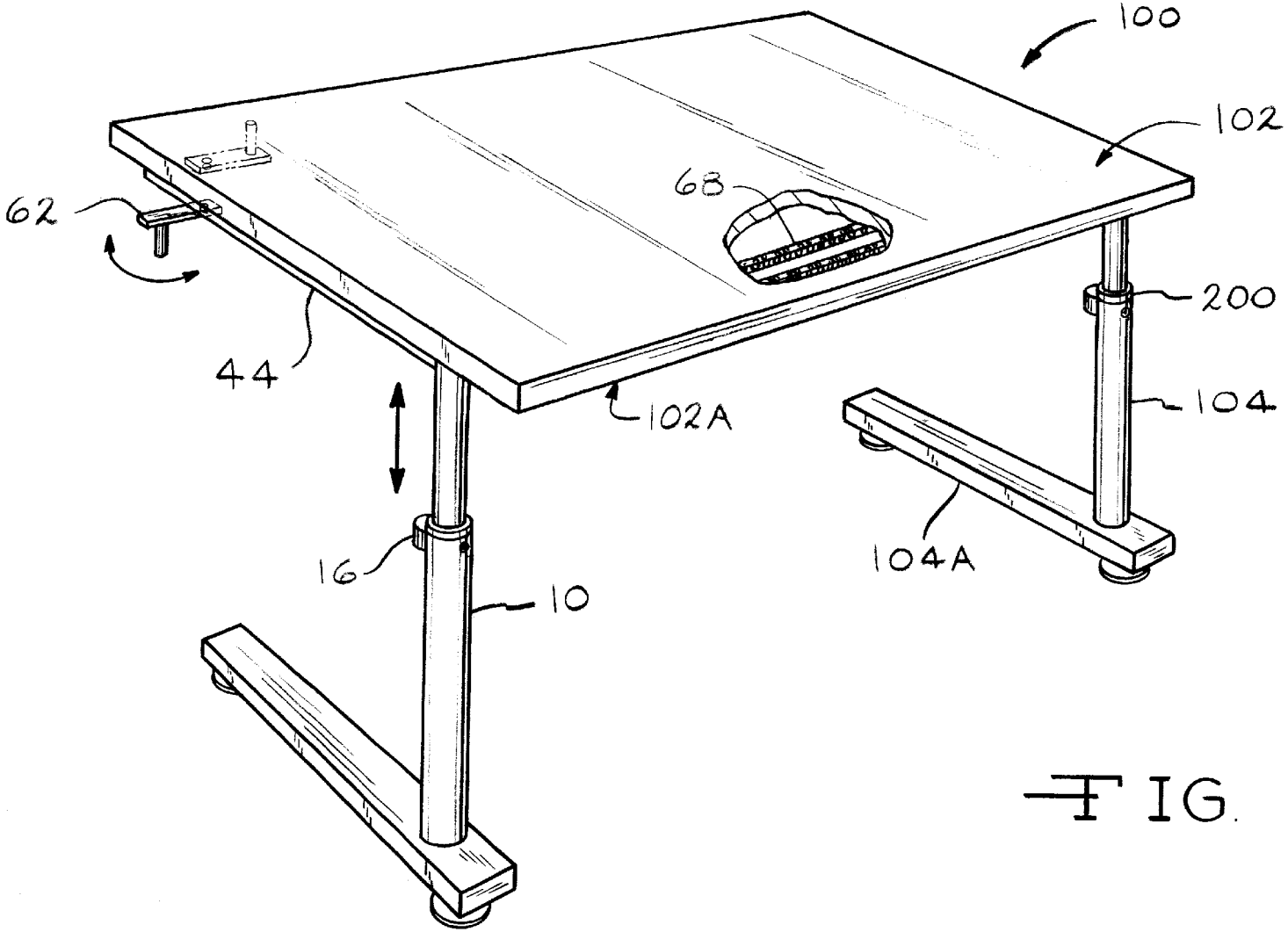
FIG. 1 is a perspective view of the workstation 100 having the adjustment mechanism 10.

FIG. 1 shows the workstation 100 having the adjustment mechanism 10 of the present invention. The adjustment mechanism 10 provides a portion of one (1) of the legs 104 for the workstation 100. The other legs 104 of the workstation 100 can be provided with secondary adjustment mechanisms 200 which do not include the operating system. The adjustment mechanism 10 extends between the foot 104A of the leg 104 and the work surface 102. In the embodiment shown, the workstation 100 has a rectangular work surface 102 with a pair of legs 104 spaced apart beneath the work surface 102. However, it is understood that the work surface 102 could be of any size or shape. In addition, the number of adjustment mechanisms 10 and secondary adjustment mechanisms 200 would depend on the size of the work surface 102 and the load (not shown) on the work surface 102. In the current embodiment, the adjustment mechanism 10 is not enclosed within a housing. However, it is understood that the adjustment mechanism 10 can be enclosed in a housing or outer fascia having any shape.

Figure 3:
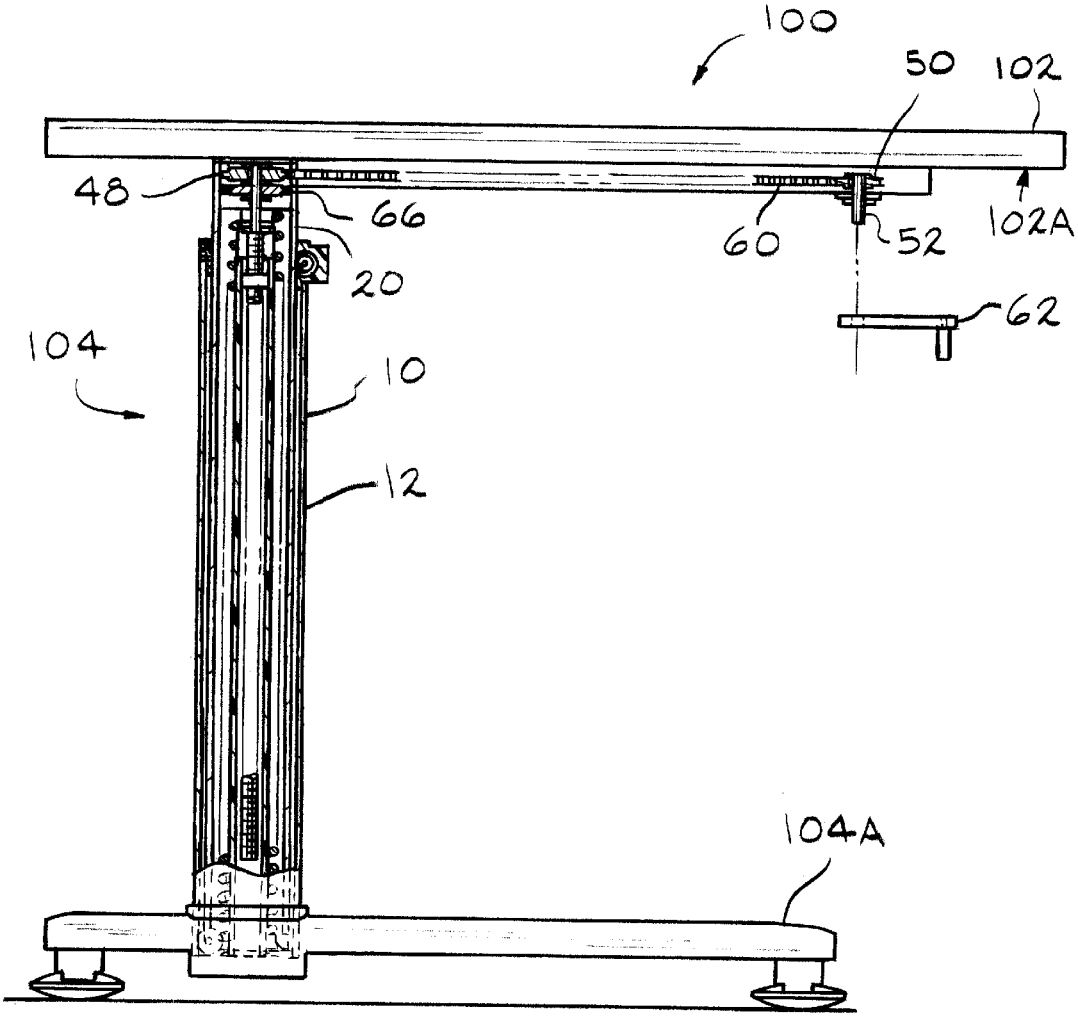

The adjustment mechanism 10 of the present invention includes a stationary first or outer member 12 and a movable second or inner member 20 (FIGS. 2 and 3). The members 12 and 20 are telescopingly mounted together such that the inner member 20 is able to move relative to the outer member 12 essentially along the longitudinal axis A—A of the adjustment mechanism 10. In the preferred embodiment, the members 12 and 20 are tubes having a cylindrical shape with a circular cross-section. However, it is understood that the members 12 and 20 could have any cross-sectional shape. In the preferred embodiment, the members 12 and 20 both have the same cross-sectional shape. However, the members 12 and 20 could have different cross-sectional shapes provided the members 12 and 20 are able to be telescopingly mounted together. The members 12 and 20 are preferably constructed of metal; however, the members 12 and 20 can be constructed of any durable, strong material.

The outer member 12 has a first or upper end 12A and a second or lower end 12B with a center bore 12C extending therebetween. The upper end 12A of the outer member 12 is open to allow for insertion of the inner member 20. The lower end 12B of the outer member 12 can be open or closed. In the preferred embodiment, the outer member 12 is fixably mounted at the lower end 12B to the foot 104A of the leg 104 of the workstation 100 (FIGS. 2 and 3). The lower end 12B of the outer member 12 can also extend through the foot 104A and be mounted in the foot 104A. A bracket (not shown) is preferably located on the lower end 12B of the first member 12. The bracket extends across the open lower end 12B of the outer member 12 and allows for mounting of the nut support 36. The bracket also provides a surface to which the bottom 40B of the spring 40 rests and pushes against. In an alternative embodiment (not shown), the bracket at the lower end 12B of the outer member 12 is a plate which extends completely across and completely covers and closes the lower end 12B of the outer member 12. In the preferred embodiment, a first cantilever bracket 16 is mounted in the upper end 12A of the first member 12 (FIG. 5). The first cantilever bracket 16 has an essentially circular shape with a D-shaped protrusion on one side and a center opening 16A having a circular shape (FIG. 6). In the preferred embodiment, the first cantilever bracket 16 is mounted in the center bore 12C of the outer member 12 adjacent the upper end 12A. The upper end 12A of the outer member 12 is provided with a notch which accommodates the D-shaped protrusion of the first cantilever bracket 16. A first cantilever roller 18 is mounted in the D-shaped protrusion of the first cantilever bracket 16. The axis of rotation of the first cantilever roller 18 is perpendicular to the longitudinal axis A—A of the adjustment mechanism 10. The first cantilever roller 18 can be of any well known type such as a roller bearing and can be constructed of any durable, low friction material. The first cantilever roller 18 preferably has an apple-core shape and is mounted in the D-shaped protrusion such as to extend into the center opening 16A of the first cantilever bracket 16. The first cantilever roller 18 extends into the center opening 16A such that the roller 18 contacts the outer surface of the inner member 20 as the inner member 20 moves within the center bore 12C of the outer member 12. The radius or curvature of the center portion of the first cantilever roller 18 is preferably substantially similar to the radius or curvature of the outer surface of the inner member 20. The first cantilever bracket 16 assists in allowing the inner member 20 to move smoothly in the outer member 12 when the work surface 102 is tilted or cantilevered which results in a tilting of the inner member 20 in the outer member 12. The first cantilever bracket 16 is preferably constructed of plastic; however, it can be constructed of any durable material.

The inner member 20 has a first or upper end 20A and a second or lower end 20B with a center bore 20C extending therebetween. The lower end 20B of the inner member 20 is telescopingly received in the open, upper end 12A of the outer member 12 (FIG. 5). The outer diameter of the inner member 20 is of a size such that the inner member 20 easily slides within the center bore 12C of the outer member 12. A second cantilever bracket 22 is mounted on the lower end 20B of the inner member 20 within the center bore 12C of the outer member 12 (FIGS. 5 and 6). The second cantilever bracket 22 has a center opening 22A which allows the spring 40, screw 26 and nut support 36 to extend between the ends 12A, 12B and 20A, 20B of the outer and inner members 12 and 20. The size of the center opening 22A is such that the spring 40 does not contact the second cantilever bracket 22 and can move easily within the center opening 22A of the bracket 22. The second cantilever bracket 22 includes a roller 23 on a side opposite the front edge 102B of the work surface 102 when the adjustment mechanism 10 is mounted to the work surface 102. The axis of rotation of the roller 23 is perpendicular to the longitudinal axis A—A of the adjustment mechanism 10. The second cantilever roller 23 is mounted on the second cantilever bracket 22 such that the roller 23 extends beyond the outer surface of the inner member 20. The inner member 20 is provided with a slot such that the roller 23 extends through the inner member 20. In the preferred embodiment, the roller 23 is spaced a minimal distance from the inner surface of the outer member 12 when the second member 20 is sliding within the center bore 12C of the outer member 12 during normal conditions such that if the inner member 20 is cantilevered or tilted, the second cantilever roller 23 contacts the inner surface of the outer member 12. The center portion of the roller 23 has a convex curvature which has a radius similar to the radius of the inner surface of the outer member 12. The roller 23 can be of any type such as a roller bearing and can be constructed of any well known, durable, low friction material.

The upper end 20A of the inner member 20 is preferably fixably mounted to a first mounting bracket 14 which is mounted on the underneath surface 102A of the work surface 102 (FIG. 4). The first mounting bracket 14 preferably has a rectangular, plate-like shape and can be fastened to the underneath surface 102A of the work surface 102 by any well-known means. The upper end 20A of the inner member 20 is preferably welded to the first mounting bracket 14. The first mounting bracket 14 preferably has a center opening to allow for insertion and removal of the driven sprocket 48 and the alignment sprocket 66 (FIG. 7). The upper end 20A of the inner member 20 is preferably provided with a cutout portion to allow the chain 60 for the operating mechanism and the alignment chain 68 for the alignment assembly to extend into the inner member 20 and around the driven sprocket 48 and the alignment sprocket 66. In an alternative embodiment (not shown), the upper end of the inner member is secured directly to the underneath surface of the work surface. An inner plate 24 is provided in the center bore 20C of the inner member 20 spaced down from but adjacent to the upper end 20A of the inner member 20 (FIG. 4). The inner plate 24 closes the center bore 20C of the inner member 20 at the upper end 20A except for a center opening 24A through the inner plate 24. The center opening 24A is positioned in an indention 24B in the center of the inner plate 24. The center opening 24A and the indention 24B preferably both have a circular shape.

A threaded member or screw 26 is rotatably mounted in the center bore 20C of the inner member 20. The outer surface of the screw 26 is provided with threads except for a top portion 26C of the screw 26 adjacent the upper end 20A of the inner member 20 (FIG. 4). The top portion 26C of the screw 26 preferably has a smaller diameter than the remainder of the screw 26. A shoulder 26D is formed at the point where the reduced diameter top portion 26C of the screw 26 begins. The screw 26 has a first end 26A and a second end 26B. The first end 26A of the screw 26 preferably extends through the center opening 24A of the inner plate 24 and beyond the upper end 20A of the inner member 20. In the preferred embodiment, the first end 26A of the screw 26 is spaced slightly down from the underneath surface 102A of the work surface 102 (FIG. 4). A thrust assembly 28 and 30 is preferably positioned on either side of the inner plate 24 around the screw 26. The thrust assemblies 28 and 30 include a thrust bearing 28A or 30A spaced between a pair of thrust washers 28B or 30B. The first thrust assembly 28 is spaced between the inner plate 24 and the shoulder 26D formed by the top portion 26C of the screw 26. The second thrust assembly 30 is spaced around the top portion 26C of the screw 26 adjacent a floor of the indention 24B of the inner plate 24. A lock clip 32 is mounted in a groove 26E in the top portion 26C of the screw 26 adjacent the second thrust assembly 30 and holds the second thrust assembly 30 in place adjacent the floor of the indention 24B of the inner plate 24. A flange bearing 34 is preferably mounted in the indention 24B of the plate 24 adjacent the top of the indention 24B. The flange bearing 34 has a center opening through which the top portion 26C of the screw 26 rotatably extends. The flange bearing 34 acts to align the screw 26 such that the screw 26 is co-axial with the inner and outer members 12 and 20. The screw 26 extends downward from the first end 26A toward the lower end 20B of the inner member 20. The second end 26B of the screw 26 extends into a first end 36A of a nut support 36.

As shown in FIG. 5, the nut support 36 has a first end 36A and a second end 36B with a center bore 36C extending therebetween. In the preferred embodiment, the center bore 36C extends completely through the nut support 36. However, the second end 36B of the nut support 36 may be closed and the center bore 36B may not extend the complete length of the support 36. The length of the center bore 36B of the nut support 36 depends on the length of the screw 26. The diameter of the center bore 36C of the nut support 36 is greater than the diameter of the screw 26 such that the screw 26 easily extends into the center bore 36C of the nut support 36. A top nut 38 is mounted in the first end 36A of the nut support 36. The top nut 38 can be mounted in the nut support 36 by any well known means. The top nut 38 and nut support 36 could also be constructed as a single piece. The nut support 36 acts to support the top nut 38 in a fixed position spaced a distance from the lower end 12B of the outer member 12. The nut support 36 is of such a length that the top nut 38 is positioned in the center opening 16A of the first cantilever bracket 16. The top nut 38 has a threaded center opening which leads to the center bore 36C of the nut support 36. The diameter and threads of the threaded opening are such as to engage the threads of the screw 26 as the screw 26 extends through the threaded opening of the top nut 38 and into the center bore 36C of the nut support 36. The second end 36B of the nut support 36 is fixably mounted on the bracket at the second end 12B of the outer member 12. The length of the nut support 36 is preferably less than the length of the outer member 12 such that the top nut 38 of the nut support 36 is spaced below the upper end 12A of the outer member 12. The nut support 36 is preferably constructed of metal; however, any well known, durable material can be used.

A spring 40 preferably extends between the bracket at the lower end 12B of the outer member 12 and the inner plate 24 at the upper end 20A of the inner member 20. The spring 40 is preferably mounted around the screw 26 and the nut support 36 and has an outer diameter such as to be spaced apart from the inner surface of the inner member 20. The bottom end 40B of the spring 40 preferably rests on the bracket at the lower end 12B of the outer member 12. The force on the spring 40 due to its compressed condition tends to keep the spring 40 in position on the bracket. The top end 40A of the spring 40 is adjacent the inner plate 24 of the inner member 20. The spring 40 preferably counteracts the downward force of the work surface 102, operating mechanism, the inner member 20 and any load on the work surface 102. The characteristics of the spring 40 are preferably chosen based on the anticipated load to be provided on the work surface 102. Although a spring is preferred, it is understood that any resilient means well known in the art such as a gas shock or gas spring could be used.

In the preferred embodiment, a spring support 42 extends between the inner plate 24 of the inner member 20 and the second end 20B of the second member 20. The spring support 42 preferably does not extend into the center opening 22A of the second cantilever bracket 22. The outer diameter of the spring support 42 is preferably only slightly less than the inner diameter of the spring 40 such that the spring 40 fits snugly on the spring support 42. In the preferred embodiment, the indention 24B of the inner plate 24 has a cylindrical shape and forms a downward extension having a diameter less than the inner diameter of the spring support 42 such that the top end 42A of the spring support 42 is friction fit over the extension as it extends downward from the inner plate 24. The spring support 42 is spaced between the extension and the spring 40. In the preferred embodiment, the top end 40A of the spring 40 is held between the top end 42A of the spring support 42 and the inner plate 24 which holds the top end 40A of the spring 40 in position. In an alternate embodiment (not shown), the inner diameter of the spring support 42 is only slightly greater than the outer diameter of the spring 40 such that the spring 40 fits within the inner bore of the spring support 42. The spring 40 is spaced between the spring support 42 and the screw 26. In this embodiment, the top end of the spring support 42 rests against the inner plate 24. The top end 40A of the spring 40 preferably rests against a washer spaced between the first and second thrust assemblies 28 and 30. The spring support 42 is preferably constructed of plastic; however, any well known durable material can be used.

As seen in FIGS. 2 and 7, the operating mechanism used to rotate the screw 26 of the adjustment mechanism 10 and adjust the work surface 102 includes a driven sprocket 48, a drive sprocket 50, a chain 60 and a handle 62. The operating mechanism is preferably positioned adjacent the underneath surface 102A of the work surface 102. The chain 60, drive sprocket 50 and shaft 52 of the operating mechanism are preferably enclosed by a mounting cover 44. The driven sprocket 48 for the operating mechanism is preferably fixably mounted on the top portion 26C of the screw 26. However, the driven sprocket 48 can be positioned along any portion of the screw 26. The driven sprocket 48 is preferably fixably mounted on the screw 26 above the inner plate 24 by a key and slot arrangement or a woodruff key. In the preferred embodiment, the driven sprocket 48 is completely within the center bore 20C of the second member 20. The driven sprocket 48 is spaced from the flange bearing 34 in the indention 24B of the inner plate 24.

The drive sprocket 50 is fixably mounted on a shaft 52 spaced apart from the driven sprocket 48. One (1) end of the shaft 52 is rotatably mounted in a second mounting bracket 46 secured on the underneath surface 102A of the work surface 102. The second mounting bracket 46 extends over and along the sides of the drive sprocket 50 and keeps the drive sprocket 50 in place on the shaft 52. The drive sprocket 50 is preferably in the same plane as the driven sprocket 48 and the longitudinal axis of the shaft 52 is preferably parallel to the longitudinal axis A—A of the adjustment mechanism 10. The drive sprocket 50 preferably has a pitch diameter greater than the pitch diameter of the driven sprocket 48. In the preferred embodiment, the driven sprocket 48 has a pitch diameter of 1.203 inch (3.06 cm) and the drive sprocket 50 has a pitch diameter of 04.30 inch (10.92 cm). The drive sprocket 50 is approximately 3.57 times greater in diameter than the driven sprocket 48. The driven and drive sprockets 48 and 50 are connected together by a chain 60. However, it is understood that the driven and drive sprockets 48 and 50 can be connected by any other means which allows for simultaneous rotation of the driven and drive sprockets 48 and 50. The drive sprocket 50, second mounting bracket 46 and the chain 60 are preferably covered by a cover 64 (FIG. 7). The cover 64 prevents potential damage to the drive sprocket 50, second mounting bracket 46 and the chain 60 and also reduces the potential of harm to a user. A handle 62 is preferably directly connected to the shaft 52 and allows for rotation of the shaft 52. The handle 62 can be of any type and can be connected to the shaft 52 in any way such as to rotate the shaft 52. The shaft 52 preferably has a length such as to extend downward beyond and through an opening in the cover 64 such that the handle 62 is located outside of the cover 62. In an alternative embodiment, the shaft 52 extends upward through the work surface 102 and the handle 62 is located above the work surface 102 (FIG. 1). The drive sprocket 50 is preferably spaced apart from the driven sprocket 48 toward the front or side of the workstation 100 such that the handle 62 is easily accessible to the user. The handle 62 preferably is of such a length as to be easily accessible to a user. The length of the handle 62 will also effect the amount of effort or force a user must supply to rotate the handle 62 and screw 26. The sprockets 48 and 50 are preferably constructed of plastic. However, any durable material can be used.

In embodiments having an adjustment system having more than one (1) adjustment mechanism 10 or having an adjustment mechanism 10 and a secondary adjustment mechanism 200, an alignment sprocket 66 is preferably fixably mounted on the screw 26. In the preferred embodiment, the alignment sprocket 66 is mounted on the top portion 26C of the screw 26 adjacent the driven sprocket 48 such that the alignment sprocket 66 is spaced between the driven sprocket 48 and the inner plate 24. However, the alignment sprocket 66 can be positioned anywhere on the screw 26. The alignment sprockets 66 and 266 of each of the adjustment mechanisms 10 or secondary adjustment mechanism 200 are preferably connected together by an alignment chain 68. However, any connection means can be used such that when the screw 26 of one of the adjustment mechanisms 10 is rotated, the screws 26 of the other adjustment mechanisms 10 or secondary adjustment mechanisms 200 are also rotated at the same rate.

A chain guide 70 and 72 is preferably mounted around the driven sprocket 48 and the alignment sprocket 66 or 266 when present on the adjustment mechanism 10. The chain guides 70 and 72 preferably have a C-shape with a gap 70A (one shown) along one portion into the center opening (FIG. 8). The gap 70A into the center opening allows for the chain 60 or 68 to extend around the driven or alignment sprocket 48 or 66. The width of the gap 70A is preferably only slightly greater than the spaced apart distance of the sides of the chain 60 or 68 as the chain 60 or 68 comes around the sprocket 48, 66 or 266 and leaves the sprocket 48, 66 or 266 (FIG. 7). The sides of the chain guide 70 and 72 adjacent the gap 70A preferably contact the chain 60 or 68 as the chain 60 or 68 moves to prevent the chain 60 or 68 from disengaging from the sprockets 48, 66 or 266. However, in an alternate embodiment (not shown), one of the sides of the gap contacts the chain 60 or 68 at all times. In the preferred embodiment of the adjustment mechanism 10 having the driven sprocket 48 and the alignment sprocket 66 spaced between the underneath surface 102A of the work surface 102 and the inner plate 24 of the inner member 20, the chain guide 70 and 72 preferably extend the entire length between the underneath surface 102A of the work surface 102 and the inner plate 24 (FIG. 4). The chain guides 70 and 72 extend around the sprockets 48 and 50 and are spaced between the inner surface of the inner member 20 and the chain 60 or 68. The chain guide 70 or 72 prevents the chains 60 or 68 from moving off the driven sprocket 48 or alignment sprocket 66. In the embodiment having a secondary adjustment mechanism 200, a chain guide is preferably provided around each alignment sprocket 66 and 266. The chain guides 70 and 72 are preferably constructed of plastic.

To adjust the height of the work surface 102, the user rotates the handle 62 of the operating mechanism. When the user rotates the handle 62, the handle 62 directly rotates the shaft 52 having the drive sprocket 50. As the drive sprocket 50 rotates, the chain 60 connecting the driven sprocket 48 to the drive sprocket 50, causes the driven sprocket 48 to rotate. Since the driven sprocket 48 is fixably mounted on the screw 26, rotating the driven sprocket 48 also rotates the screw 26. The driven and drive sprockets 48 and 50 of the operating mechanism provide a reduction ratio which allows for greater movement of the work surface 102 with fewer rotations of the handle 62. In the preferred embodiment, due to the difference in diameters of the driven and drive sprockets 48 and 50, when the handle 62 is rotated one (1) complete rotation, the screw 26 rotates 3.57 rotations. In the preferred embodiment, there is approximately a 3.57:1 reduction ratio from the handle 62 to the screw 26 through the sprockets 48 and 50. In the preferred embodiment, the screw 26 is double threaded and has ten (10) threads per inch such that when the screw 26 rotates approximately five (5) full rotations, the screw 26 and consequently the work surface 102A moves up or down one (1) inch (2.54 cm). Thus, for one (1) full rotation of the handle 62, the work surface 102 is adjusted up or down approximately 0.72 inch (1.83 cm). The driven and drive sprockets 48 and 50 of the operating mechanism can be chosen to provide any increase in the rotation ratio from the handle 62 to the screw 26.

Whether the user wants to adjust the work surface 102 up or down determines the direction the handle 62 is turned. The screw 62 preferably rotates in the same direction as the direction of rotation of the shaft 52 and handle 62. As the screw 26 rotates, the screw 26 moves up or down through the top nut 38, depending on the direction of rotation. The movement of the screw 26 up or down in the stationary top nut 38 causes the inner member 20 which is fixed to the screw 26 to also move up and down within the outer member 12 which is fixed to the nut support 36 and top nut 38. In the preferred embodiment, under normal conditions, the load on the work surface 102 is spaced between the front edge 102B of the work surface 102 and the legs 104 or adjustment mechanism 10 of the workstation 100. The load causes the work surface 102 to tilt or pivot toward the load. Since the work surface 102 is connected to the inner member 20, without the rollers 18 and 23, tilting of the work surface 102 would cause the inner member 20 to tilt in the outer member 12 and cause the lower end 20B of the inner member 20 to move off center toward the inner surface of the outer member 12. Therefore, during normal use of the adjustment mechanism 10, the load is tending to cantilever or tilt the inner member 20 in the outer member 12. As the inner member 20 moves up and down relative to the outer member 12, the first cantilever roller 18 of the first cantilever bracket 16 contacts the outer surface of the inner member 20 and act to align the inner member 20 in the center bore 12C of the outer member 12 such that the outer and inner members 12 and 20 are co-axial. The first cantilever roller 18 carries the cantilevered load on the second member 20 as it enters the first member 12 caused by a load on a front edge 102B of the work surface 102 in front of the legs 104 of the workstation 100. The first cantilever roller 18 preferably also prevents chattering of the adjustment mechanism 10 as the inner member 20 moves relative to the outer member 12. In the preferred embodiment, as the inner member 20 moves up and down in the outer member 12, the second cantilever roller 23 of the second cantilever bracket 22 at the lower end 20B of the inner member 20 contacts the inner surface of the outer member 12. The second cantilever roller 23 of the second cantilever bracket 22 tends to prevent excess movement of the lower end 20B of the inner member 20 in the outer member 12. The second cantilever roller 23 allows the inner member 20 to continue to move within the outer member 12 with very little function when the work surface 102 is tilted.

In one (1) embodiment, a primary adjustment mechanism 10 and at least one (1) secondary adjustment mechanism 200 is used to adjust the work surface 102. The secondary adjustment mechanism 200 is preferably similar to the adjustment mechanism 10 except that the secondary adjustment mechanism 200 does not have a driven sprocket 48, drive sprocket 50, chain 60, shaft 52, handle 62 or second mounting bracket 46. The secondary adjustment mechanism 200 is operated through rotation of the alignment sprocket 266 which is connected to the alignment sprocket 66 of the adjustment mechanism 10. As the screw 26 rotates, the alignment sprocket 66 mounted at the top end 26C of the screw 26 also rotates. Since the alignment sprockets 66 or 266 of each adjustment mechanism 10 or 200 for a workstation 100 are connected together, when one (1) screw 26 of one (1) adjustment mechanism 10 is rotated, the screws 26 of the other adjustment mechanisms 10 are also rotated. Use of the alignment system allows for use of a single handle 62 and single operating mechanism to operate all the adjustment mechanisms 10 of a workstation 100 simultaneously. The alignment system also ensures that all of the adjustment mechanisms 10 are operating identically at the same speed in the same direction.

The spring 40 of the adjustment mechanism 10 compensates for the weight of the work surface 102, the inner member 20, the operating mechanism including the cover 64, drive sprocket 50 and the first and second mounting bracket 14 and 46 and any load on the work surface 102. Due to the use of the 3.57:1 ratio of the sprockets 48 and 50, without the use of the spring 40 to assist in compensating for the weight of the work surface 102, operating mechanism and load, the amount of force required to rotate the handle 62 would be outside the normal range of force able to be applied by an average user. The spring 40 regulates how much inch pounds (in-lbs) (NM) of torque will be needed to turn the handle 62 to adjust the work surface 102.

In one (1) embodiment, having one (1) primary adjustment mechanism 10 and one (1) secondary adjustment mechanism 200, the springs 40 are identical and are chosen to act together to compensate for the weight of the work surface 102 and the weight of the adjustment mechanism 10 and 200. In this embodiment, the work surface 102 weighs approximately 31 lbs (14 kg) and the adjustment mechanisms 10 and 200 together weigh approximately 23 lbs (10 kg). The load on the work surface 102 is chosen to be between 0 to 100 lbs (0 to 45 kg) with an average load of 50 lbs (23 kg). In this embodiment, the work surface 102 is able to be adjusted a total distance of 16 inches (38.4 cm) such that in the fully lowered position, the work surface 102 is 26 inches (66 cm) away from the ground surface and in the fully raised position, the work surface 102 is 42 inches (107 cm) away from the ground surface. The springs 40 are chosen such that when the work surface 102 is adjusted halfway or is positioned 34 inches (86 cm) away from the ground surface and a load of 50 lbs (23 kg) is on the work surface 102, everything is balanced and the force or torque needed to rotate the handle 62 is approximately 0 lbs (0N). Theoretically, at the neutral position, the only force needed to rotate the handle 62 to adjust the work surface 102 is the force needed to overcome the friction of the adjustment mechanisms 10 and 200. The springs 40 are also chosen such that the maximum torque or force needed to rotate the handle 62 to raise the work surface 102 having a load of 100 lbs (45 kg) to the fully raised position does not exceed 12 lbs (53 N). In this embodiment, the handle 62 preferably has a length of 4.0 inches (10.2 cm). The force required to rotate the handle 62 increases to the maximum as the work surface 102 is moved toward the fully lowered position and there is no load on the work surface 102. The force required to rotate the handle 62 also increases to the maximum as the work surface 102 is moved to the fully raised position and there is a maximum load of 100 lbs (45 kg) on the work surface 102. In this embodiment, the force required to rotate the handle 62 increases or decreases at a rate of about 4 lbs/inch. (700 N/M) or 2 lbs/inch (350 N) per adjustment mechanism 10 or 200. As the springs 40 are compressed or extended, the upward force of the springs 40 applied to the work surface 102 varies linearly. The application of the upward force by the springs 40 makes it easier for the adjustment mechanisms 10 and 200 to adjust the work surface 102 quickly, particularly when the work surface 102 has an additional weight or load. Thus, the springs 40 of the adjustment mechanisms 10 and 200 in combination with the aggressive rotation ratio of the sprockets 48 and 50 of the operating system allow the user to use a reasonable force to quickly adjust the height of the work surface 102. To compensate for a heavier work surface 102, the springs 40 of the adjustment mechanism 10 and the secondary adjustment mechanism 200 can be pre-loaded. In one (1) embodiment having a primary adjustment mechanism 10 and a secondary adjustment mechanism 200, the springs 40 are pre-loaded by providing a spacer (not shown) between the bottom end 40B of the spring 40 and the bracket. The insertion of the spacer causes the springs 40 to compress. For a spring 40 providing a force of 2 lbs/inch (350 N/M), using a five (5) inch (12.7 cm) spacer would increase the force applied by the spring 40 by 10 lbs (44.8 N). Thus, the total increase in force provided by both mechanisms 10 or 200 would be 20 lbs (89.6 N). The use of a spacer and the ability to pre-load the spring 40 allow the adjustment mechanisms 10 or 200 to be used for a variety of work surfaces 102 having different weights or having different average loads.

It is intended that the foregoing description be only illustrative of the present invention and that the present invention be limited only by the hereinafter appended claims.

I claim:

1. An adjustment mechanism for vertically adjusting a work surface of a workstation, which comprises:

(a) a stationary first member defining a longitudinal axis of the mechanism;

(b) a movable second member connected to the work surface of the workstation and being movable relative to the stationary first member in a substantially vertical direction along the longitudinal axis of the mechanism;

(c) a support fixably mounted to the stationary first member and having a threaded opening extending substantially along the longitudinal axis of the mechanism;

(d) a threaded member rotatably connected to the movable second member and extending through the threaded opening of the support wherein threads of the threaded member engage threads of the threaded opening;

(e) a resilient means extending between the first member and the second member substantially along the longitudinal axis of the mechanism and tending to bias the members apart;

(f) one driven sprocket fixably mounted on the threaded member adjacent to the work surface;

(g) one drive sprocket directly connected to the driven sprocket and mounted on a shaft rotatably mounted on the work surface, the drive sprocket having a diameter greater than a diameter of the driven sprocket;

(h) means for directly connecting the driven sprocket and the drive sprocket; and (i) means for rotating the shaft and the drive sprocket wherein when the drive sprocket rotates, the driven sprocket is rotated which rotates the threaded member in the threaded opening of the support such that the second member is moved relative to the first member.

2. The adjustment mechanism of claim 1 wherein the resilient means is a spring.

3. The adjustment mechanism of claim 2 wherein the spring extends between an end of the first member opposite the second member and an end of the second member opposite the first member.

4. The adjustment mechanism of claim 1 wherein the resilient means is chosen such that at a halfway point in movement of the second member relative to the first member, a force of the resilient means tending to bias the members apart acts to counterbalance a force of the work surface, driven sprocket, drive sprocket, means for rotating the drive sprocket, second member and load tending to move the members together.

5. The apparatus of claim 1 wherein the force exerted by the resilient means is such that the threaded member can be in tension or compression depending on a load on the work surface.

6. The adjustment mechanism of claim 1 wherein the diameters of the driven sprocket and drive sprocket are such that when the shaft is rotated one complete rotation, the threaded member rotates greater than one complete rotation.

7. The adjustment mechanism of claim 1 wherein the diameter of the drive sprocket is 3.57 times greater than the diameter of the driven sprocket.

8. The adjustment mechanism of claim 1 wherein diameters of the drive sprocket and driven sprocket are such that when the shaft is rotated one complete rotation, the threaded member rotates approximately 3.57 rotations.

9. The adjustment mechanism of claim 1 wherein the means for connecting the drive sprocket and driven sprocket is a chain and wherein a chain guide is positioned in an end of the second member adjacent the driven sprocket such that the chain does not disengage from the driven sprocket.

10. The adjustment mechanism of claim 9 wherein the chain guide is mounted around the driven sprocket spaced between an inner surface of the second member and the driven sprocket and chain.

11. The adjustment mechanism of claim 1 wherein mounted adjacent the driven sprocket on the threaded member is a first alignment sprocket having a chain connected to a second alignment sprocket on a second threaded member in a second adjustment mechanism so that a height of the adjustment mechanisms are the same throughout movement of the second member and wherein chain guides are mounted adjacent the first alignment sprocket and the second alignment sprocket so that the chain does not disengage from the first alignment sprocket or the second alignment sprocket.

12. The adjustment mechanism of claim 10 wherein the chain guide has a C-shape and wherein, a radius and curvature of an inner opening of the chain guide is substantially similar to a radius and curvature of the driven sprocket with the chain.

13. The adjustment mechanism of claim 11 wherein the chain guides have a C-shape and wherein, a radius and curvature of an inner opening of the chain guides is substantially similar to a radius and curvature of the first and second alignment sprockets with the chain.

14. The adjustment mechanism of claim 1 wherein the threaded member is double threaded with 10 threads per inch such that when the drive sprocket is rotated one complete revolution, the threaded member is rotated about 3.57 times and the work surface moves approximately 0.714 inches (1.81 cm).

15. The adjustment mechanism of claim 1 wherein a first end of the second member is mounted on a bracket which is secured to the work surface, wherein an inner plate having a center opening is mounted in a center bore of the second member spaced apart from the bracket, wherein the threaded member extends through the center opening in the inner plate and the driven sprocket is mounted on the threaded member between the bracket and the inner plate and wherein a guide is mounted in the bore of the second member adjacent the driven sprocket and prevents the connection means from moving off the driven sprocket.

16. The adjustment mechanism of claim 1 wherein a cantilever bracket having a single roller is mounted on an end of the second member adjacent the first member wherein the roller is mounted on the cantilever bracket such as to be positioned opposite a front edge of the work surface and wherein the roller contacts the first member when the second member moves relative to the first member in a direction substantially along the longitudinal axis of the adjustment mechanism.

17. The adjustment mechanism of claim 16 wherein the roller has a convex curvature which is substantially similar to a curvature of an inner surface of the first member.

18. The adjustment mechanism of claim 1 wherein a cantilever bracket having a single roller is mounted in an end of the first member adjacent the second member and assists the second member in moving relative to the first member.

19. The adjustment mechanism of claim 18 wherein the roller has an apple core shape and wherein a center portion of the roller has a concave curvature substantially similar to a curvature of an outer surface of the second member.

20. The adjustment mechanism of claim 1 wherein the adjustment mechanism has an alignment sprocket mounted on the threaded member, wherein the alignment sprocket of the adjustment mechanism is connected by at least one chain to at least one alignment sprocket of at least one secondary adjustment mechanism connected to the work surface wherein the secondary adjustment mechanism is similar to the adjustment mechanism except that the secondary adjustment mechanism does not have the driven and drive sprockets, the shaft and the means to rotate the shaft, wherein the connection of the adjustment mechanism to the secondary adjustment mechanism allows the adjustment mechanisms to adjust the work surface of the workstation at a similar rate.

21. The adjustment mechanism of claim 15 wherein the second member has opposed ends with a center bore extending therebetween with an inner plate mounted in the center bore adjacent one end wherein the inner plate has an opening through which the threaded member extends wherein a thrust assembly is mounted on the threaded member on either side of the inner plate such that the threaded member easily rotates in the opening of the inner plate and wherein the opening of the inner plate is located in an indention in the plate and wherein a flange bearing is mounted in the indention and wherein the threaded member extends through an opening in the flange bearing.

22. A system for adjusting a height of a work surface of a workstation, which comprises:

(a) a primary adjustment mechanism including:

i. a stationary first member defining a longitudinal axis of the mechanism;

ii. a movable second member connected to the work surface of the workstation and being movable relative to the stationary first member in a substantially vertical direction along the longitudinal axis of the mechanism;

iii. a support fixably mounted to the stationary first member and having a threaded opening extending substantially along the longitudinal axis of the mechanism;

iv. a threaded member rotatably connected to the movable second member and extending through the threaded opening of the support wherein threads of the threaded member engage threads of the threaded opening;

v. a resilient means extending between the first member and the second member substantially along the longitudinal axis of the mechanism and tending to bias the members apart;

vi. one driven sprocket fixably mounted on the threaded member adjacent to the work surface; and vii. an alignment sprocket mounted on the threaded member adjacent the work surface;

(b) at least one secondary adjustment mechanism including:

i. a stationary first member defining a longitudinal axis of the mechanism;

ii. a movable second member connected to the work surface of the workstation and being movable relative to the stationary first member in a substantially vertical direction along the longitudinal axis of the mechanism;

iii. a support fixably mounted to the stationary first member and having a threaded opening extending substantially along the longitudinal axis of the mechanism;

iv. a threaded member rotatably connected to the movable second member and extending through the threaded opening of the support wherein threads of the threaded member engage threads of the threaded opening;

v. a resilient means extending between the first member and the second member substantially along the longitudinal axis of the mechanism and tending to bias the members apart; and vi. an alignment sprocket mounted on the threaded member adjacent the work surface;

(c) one drive sprocket directly connected to the one driven sprocket of the primary adjustment mechanism and mounted on a shaft rotatably mounted on the work surface, the drive sprocket having a diameter greater than a diameter of the driven sprocket of the primary adjustment mechanism;

(d) means for directly connecting the driven sprocket of the primary adjustment mechanism and the drive sprocket; and (e) means for rotating the shaft and the drive sprocket wherein as the drive sprocket rotates, the driven sprocket is rotated which rotates the threaded shaft of the primary adjustment mechanism and the alignment sprocket of the primary adjustment mechanism; and (f) means for connecting the alignment sprocket of the primary adjustment mechanism to the alignment sprocket of the secondary adjustment mechanism so that when the threaded shaft and the alignment sprocket of the primary adjustment mechanism rotate, the alignment sprocket and threaded member of the secondary adjustment mechanism rotate so that the primary adjustment mechanism and the secondary adjustment mechanism move at substantially the same rate.

23. The system of claim 22 wherein the resilient means of the primary adjustment mechanism and the resilient means of the secondary mechanism are each chosen such as to compensate for a portion of combined load on the primary adjustment mechanism and secondary adjustment mechanism.

24. The system of claim 23 wherein the resilient means in the primary adjustment mechanism is identical to the resilient means in the secondary adjustment mechanism such that each resilient means exerts an identical force and compensates for an equal portion of the combined load.

25. The system of claim 22 wherein the first and second members, the threaded member and the alignment sprocket of the primary adjustment mechanism are identical to the first and second members, the threaded member and the alignment sprocket of the secondary adjustment mechanism.

26. The system of claim 22 wherein the means for connecting the alignment sprockets of the primary and secondary adjustment mechanism is a chain.

27. The system of claim 26 wherein a chain guide is provided around the alignment sprockets and chain of the primary adjustment mechanism and the secondary adjustment mechanism to prevent the chain from falling off the alignment sprockets.

28. A method for adjusting a height of a work surface of a workstation which comprises the steps of:

(a) providing an adjustment mechanism for the work surface of the workstation, the adjustment mechanism including a stationary first member defining a longitudinal axis of the mechanism; a movable second member connected to the work surface of the workstation and being movable relative to the stationary first member in a substantially vertical direction along the longitudinal axis of the adjustment mechanism; a support fixably mounted to the stationary first member and having a threaded opening extending substantially along the longitudinal axis of the adjustment mechanism; a threaded member rotatably connected to the movable second member and extending through the threaded opening of the support wherein threads of the threaded member engage threads of the threaded opening; a resilient means extending between the first member and the second member substantially along the longitudinal axis of the mechanism and tending to bias the members apart; one driven sprocket fixably mounted on the threaded member adjacent to the work surface; one drive sprocket directly connected to the driven sprocket and mounted on a shaft rotatably mounted on the work surface, the drive sprocket having a diameter greater than a diameter of the driven sprocket; means for directly connecting the driven sprocket and the drive sprocket and means for rotating the shaft and the drive sprocket; and (b) activating the means for rotating the shaft and drive sprocket such that the shaft and drive sprocket rotate which rotates the threaded member in the threaded opening of the support which moves the second member relative to the first member to vertically adjust the work surface.

29. The method of claim 28 wherein the means for rotating the shaft and drive sprocket is a handle connected to the shaft and wherein when the handle is rotated one complete rotation, the threaded member rotates approximately 3.57 rotations.

30. The method of claim 28 wherein the threaded member is double threaded and contains 10 threads per inch such that when the handle is rotated one complete rotation, the work surface is adjusted approximately 0.714 inch (1.81 cm).

31. The method of claim 28 wherein the adjustment mechanism is mounted on the work surface, wherein mounted adjacent to the driven sprocket on the threaded member is a first alignment sprocket with a chain connected to a second alignment sprocket on a second threaded member in a second adjustment mechanism mounted to the work surface so that when the threaded member of the adjustment mechanism is rotated, the second threaded member is rotated and the adjustment mechanisms adjust at substantially the same rate.

* * * * *